United States Patent [19]

Nagai et al.

[11] 4,380,984

[45] Apr. 26, 1983

[54] ELECTRONIC CONTROLLED CARBURETOR

[75] Inventors: Tadashi Nagai, Yokosuka; Ken Nakamura, Kawasaki; Yasuo Nakajima, Yokosuka, all of Japan

[73] Assignee: Nissan Motor Company, Ltd., Yokohama, Japan

[21] Appl. No.: 278,396

[22] Filed: Jun. 29, 1981

[30] Foreign Application Priority Data

Jul. 1, 1980 [JP] Japan ..... 55-89872

[51] Int. Cl.[3] ..... F02B 33/00; F02M 23/04; F02B 3/00; F02M 7/14

[52] U.S. Cl. ..... 123/440; 123/438

[58] Field of Search ..... 123/440, 438; 60/276, 60/285; 261/50 R, 121 B, DIG. 74

[56] References Cited

U.S. PATENT DOCUMENTS 4,046,118 9/1977 Aono ..... 123/438
4,057,042 11/1977 Aono ..... 123/438
4,111,170 9/1978 Nakajima et al. ..... 123/440
4,119,074 10/1978 Masaki et al. ..... 123/440
4,169,439 10/1979 Tsiang et al. ..... 123/440
4,173,952 11/1979 Asano ..... 123/440
4,173,956 11/1979 Ikeura et al. ..... 123/440
4,174,689 11/1979 Hosaka ..... 123/440

*Primary Examiner*—Raymond A. Nelli
*Attorney, Agent, or Firm*—Schwartz, Jeffery, Schwaab, Mack, Blumenthal & Koch

[57] ABSTRACT

An electronic controlled carburetor has an induction passage into which fuel is fed by a fuel metering system communicated with the atmosphere through main and auxiliary air bleed passages. The main and auxiliary air bleed passages have therein main and auxiliary solenoid valves, respectively, for altering the rate of air flow therethrough. A control circuit determines the duty ratio of a first pulse signal applied to the main solenoid valve in response to an air/fuel ratio indicative signal from an oxygen sensor. The control circuit determines the duty ratio of a second pulse signal applied to the auxiliary solenoid valve from the duty ratio of the first pulse signal so as to permit the main solenoid valve to operate around 50% duty ratio over all engine operating modes.

14 Claims, 2 Drawing Figures

ELECTRONIC CONTROLLED CARBURETOR

BACKGROUND OF THE INVENTION

1. Field of the Invention

This invention relates to an electronic controlled carburetor for use in internal combustion engines and, more particularly, to such a carburetor with feedback means responsive to selected constituents of the exhaust gases to ensure that the fuel supplied to the engine is correct to maintain a desired optimum air/fuel ratio.

2. Description of the Prior Art

It is the common practice to minimize the emission of pollutants to the ambient by using a three-way catalyst, located within the stream of exhaust gases, which catalyzes the oxidation of hydrocarbons (HC) and carbon monoxide (CO) and also the reduction of oxides of nitrogen (NOx). It has been discovered that a difficulty with such a three-way catalyst system is that if the fuel metering is too rich, the NOx will be reduced effectively, but the oxidation of CO will be incomplete. On the other hand, if the fuel metering is too lean, the CO will be effectively oxidized but the reduction of NOx will be incomplete. In order to make such a three-way catalyst system operative, it is necessary to have very accurate control over the fuel metering function to maintain a stoichiometric air fuel ratio.

It has been therefore proposed to employ an electronic controlled carburetor with feedback means responsive to the presence of selected constituents of the engine exhaust gases to ensure that the fuel supplied to the engine is correct to maintain a desired optimum air/fuel ratio such as stoichiometric. The feedback means was employed to alter the average degree of opening of a solenoid valve located in an air bleed passage means to adjust the rate of air flow introduced into a fuel passage means communicating between a fuel reservoir chamber and a carburetor induction passage. The feedback means comprises a control circuit for providing a drive pulse signal the duty ratio of which is dependent upon the selected constituents of the engine exhaust gases to the solenoid valve which thereby opens and closes the air bleed passage means with the required ratio of its "open" time to its "close" time. The solenoid valve is required to have a large dynamic range to control the air/fuel ratio of the mixture supplied to the engine over all engine operating modes. However, if the dynamic range is too large pulsations will occur in the fuel discharged into the carburetor induction passage upon the opening and closing of the solenoid valve operating with a drive pulse signal, causing air/fuel ratio variations and engine torque fluctuations which would eventually leads to engine hunting.

If the solenoid valve has its dynamic range limited in order to avoid the discharging fuel pulsation problem, the range of effective air/fuel ratio control of the solenoid valve will be restricted. For example, the solenoid valve will remain open when the vehicle runs at high altitudes and the ambient air density is low.

Accordingly, the invention as disclosed is directed generally to the solution of the above and related problems and more specifically to means permitting the solenoid valve to operate around 50% duty ratio of its "open" time to its "close" time substantially over all engine operating modes.

SUMMARY OF THE INVENTION

The present invention provides an electronic controlled carburetor for an internal combustion engine. The carburetor comprises an induction passage for supplying a combusible mixture to the engine, a source of fuel, and fuel metering means communicating between the source of fuel and the induction passage. The fuel metering means is communicated with the atmosphere through a main air bleed passage and also through an auxiliary air bleed passage. The main and auxiliary air bleed passages have therein first and second solenoid valves for altering the rate of air flow to the fuel metering means, respectively. Engine exhaust gas analyzing means is provided which is effective for sensing selected constitute of the exhaust gases of the engine and producing in response thereto an output signal. The output of the engine exhaust gas analyzing means is applied to a control circuit which operates in response thereto the first and second solenoid valves. The control circuit comprises a first comparator for providing the difference or deviation between the output of the engine exhaust gas analyzing means and a predetermined reference value, an amplifier for providing a first signal proportional to the difference, a first integrator for providing a second signal resulting from integrating the difference, an adder for providing a third signal resulting from adding the first and second signals, a first pulse generator for providing a first drive pulse signal to the first solenoid valve, the first drive pulse signal having a duty ratio dependent upon the third signal, a second comparator for providing the deviation between the second signal and a predetermined reference value, a second integrator for providing a fourth signal resulting from integrating the deviation, and a second pulse generator for providing a second drive pulse signal to the second solenoid valve, the second drive pulse signal having a duty ratio dependent upon the fourth signal.

The first pulse generator comprises a third comparator having inputs from the adder and a triangular waveform generator. The second pulse generator comprises a fourth comparator having inputs from the second integrator and the triangular waveform generator.

Preferably, the control circuit comprises feedback control inhibit means for providing an inhibit signal when the output of the engine exhaust gas analyzing means remains unchanged for a predetermined time, first switch means responsive to the inhibit signal for disconnecting the third comparator from the adder and instead connecting it to a reference voltage source, a nonvolatile memory for storing the output of the second integrator, and second switch means responsive to the inhibit signal for disconnecting the fourth comparator from the second integrator and instead connecting it to the nonvolatile memory.

BRIEF DESCRIPTION OF THE DRAWINGS

The present invention will be described in greater detail by reference to the following description taken in connection with the accompanying drawings, in which.

DESCRIPTION OF THE PREFERRED EMBODIMENT

Figure 1:
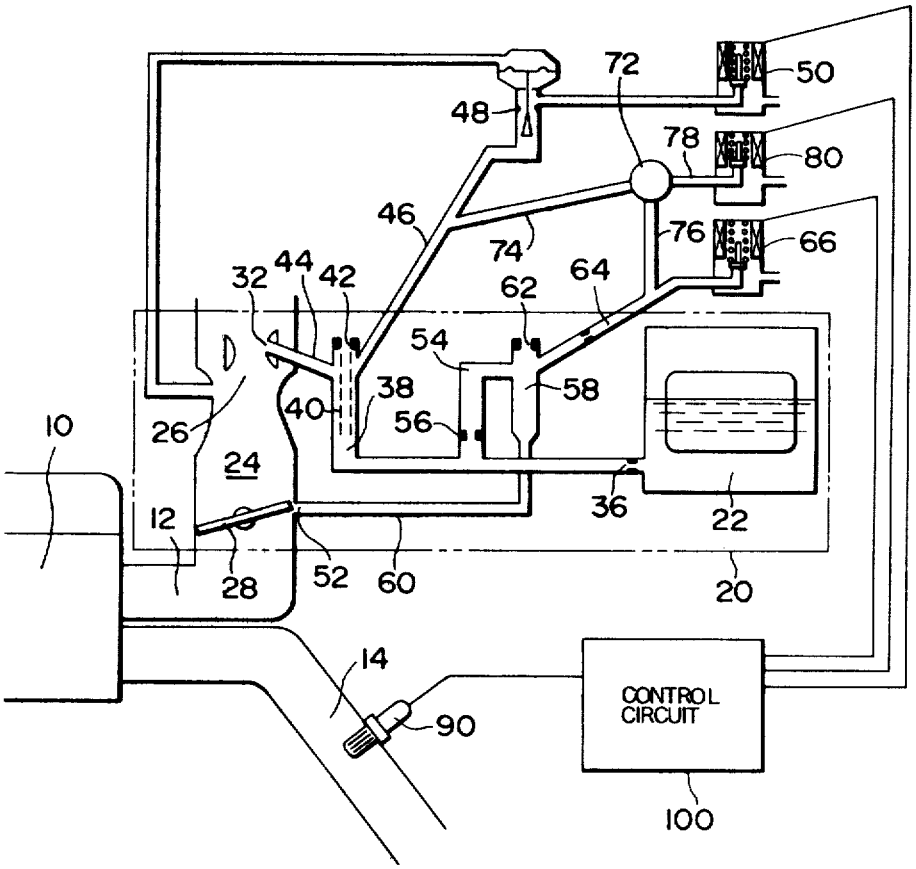
FIG. 1 is a schematic diagram showing one embodiment of an electronic controlled carburetor made in accordance with this invention.

Referring now to FIG. 1, there is illustrated one embodiment of an electronic controlled carburetor made in accordance with the present invention. In FIG. 1, the reference numeral 10 designates an internal combustion engine associated with a carburetor 20. The engine 10 has its inlet side operatively connected to an intake passage 12 through which air-fuel mixture is charged into the engine. An exhaust passage 14 is shown operatively connected to the discharge side of the engine 10 for the discharging of exhaust gases to the atmosphere.

The carburetor 20 has a float type fuel reservoir chamber 22 containing therein fuel, and an induction passage 24 formed therethrough. A venturi section, having a venturi throat 26, is provided within the induction passage 24. A variably operable throttle valve 28 is located within the induction passage 24 downstream of the venturi section. The throttle valve 28 serves to variably control the flow of air-fuel mixture through the intake passage 12 to the engine 10. A main fuel discharge nozzle 32 is situated generally within the venturi section throat 24. The main fuel discharge nozzle 32 serves to discharge fuel, as is metered by the main fuel metering system, into the induction passage 24 in the presence of the difference between the pressure in the venturi section and the air pressure within the fuel reservoir chamber 22. An idle port 52 is opened into the induction passage 24 so that it is juxtaposed to an edge of the throttle valve 28 when the throttle valve 28 is in its idle or closed position. The idle port 52 serves to discharge fuel, as is metered by the idle fuel metering system, into the induction passage 24 in the presence of relatively high manifold vacuum at idle or low engine speeds.

The main fuel metering system comprises a main fuel passage 34 communicating between the fuel reservoir chamber 22 and a generally upwardly extending main fuel well 38. The main fuel well 38 contains a main well tube 40 provided with apertures formed through the wall thereof. The upper part of the interior of the main well tube 40 is communicated with the atmosphere through an air bleed restriction means 42. A passage 44 serves to communicate between the upper part of the main fuel well 38 and the mail fuel discharging nozzle 32. A main fuel metering restriction 36 is provided in the main fuel passage 34 upstream of the main fuel well 38. The main fuel well 38 is communicated with the atmosphere through a main air bleed passage 46 which has therein a variable air bleed 48. The variable air bleed 48 serves to meter the rate of air flow into the main fuel well 38 in response to venturi vacuum. A first two-way solenoid valve 50 is provided in the main air bleed passage 46 upstream of the variable air bleed 48. The first two-way solenoid valve 50 opens and closes the main air bleed passage 46 for metering the rate of air flow therethrough. The solenoid valve 50 operates with a duty ratio of its "open" time to its "close" time dependent upon a first drive pulse signal fed thereto from a control circuit 100 which will be described in more detail later.

The idle fuel metering system is illustrated as comprising an idle fuel passage 54 provided therein with an idle fuel metering restriction 56. The idle fuel passage 54 has its one end connected to the main fuel passage 34 downstream of the main fuel metering restriction 36, the other end thereof being connected to the upper part of a generally vertically extending fuel well 58 the lower end of which communicates with a passage 60 leading to the idle port 52. The upper end of the fuel well 58 is communicated with the atmosphere through an air bleed restriction means 62 and also through an idle air bleed passage 64 which has therein a second two-way solenoid valve 66. The solenoid valve 66 opens and closes the idle air bleed passage 64 for metering the rate of air flow therethrough. The solenoid valve 66 is substantially the same in structure as the first two-way solenoid valve 50.

The carburetor 20 also comprises an auxiliary air bleed system including a three-way solenoid valve 72. The solenoid valve 72 has first and second output ports along with an inlet port. The first outlet port of the solenoid valve 72 is communicated through a first air passage 74 with the main air bleed passage 46 at a point downstream of the variable air bleed 48. A second air passage 76 communicates between the second outlet port of the solenoid valve 72 and the idle air bleed passage downstream of the second two-way solenoid valve 66. The inlet port of the solenoid valve 72 is communicated with the atmosphere through a third air passage 78 having therein a third two-way solenoid valve 80.

The three-way solenoid valve 72 is switched in accordance with engine operating conditions so as to provide communication between its inlet port and its first outlet port when fuel is drawn mainly from the main fuel discharging nozzle 32 and to establish communication between its inlet port and its second inlet port when fuel is discharged mainly from the idle port 52.

The third two-way solenoid valve 80 opens and closes the third air passage 78 for metering the rate of air flow therethrough. The solenoid valve 80 operates with a duty ratio of its "open" time to its "close" time dependent upon a second drive pulse signal fed thereto from the control circuit 100 so that the first and second two-way solenoid valves 50 and 66 can operate substantially around 50% duty ratio over all engine operating modes and compensate for sudden air/fuel ratio changes with high responsibility to sudden changes in engine operating conditions.

An oxygen sensor 90 is located within the exhaust passage 14 of the engine. The oxygen sensor 90 senses the oxygen content of the combustion products as an indication of the air/fuel ratio of the mixture created by the carburetor and provides a feedback signal causing the carburetor to create a mixture of the desired air/fuel ratio, such as stoichiometric. For example, the oxygen sensor may be of the type including a zirconia element which produces a low voltage level while sensing exhaust gas compositions with an abundance of oxygen contained therein and a high level voltage signal while sensing exhaust gas compositions with an absence of oxygen contained therein. Zirconia oxygen sensors have steep transitions between these levels at the stoichiometric point where the composition of the exhaust gas changes from oxygen rich to oxygen lean. The oxygen sensor output signal is then applied to the electric control circuit 100 which thereby determines the duty ratio of the "on" or high time of the first and second drive pulse signals to the "off" or low time thereof and controls the average degree of opening of the first, second and third solenoid valves, thereby controlling the amount of air mixed with the fuel in the main and idle fuel wells 42 and 58 to provide a desired optimum air/fuel ratio.

Figure 2:
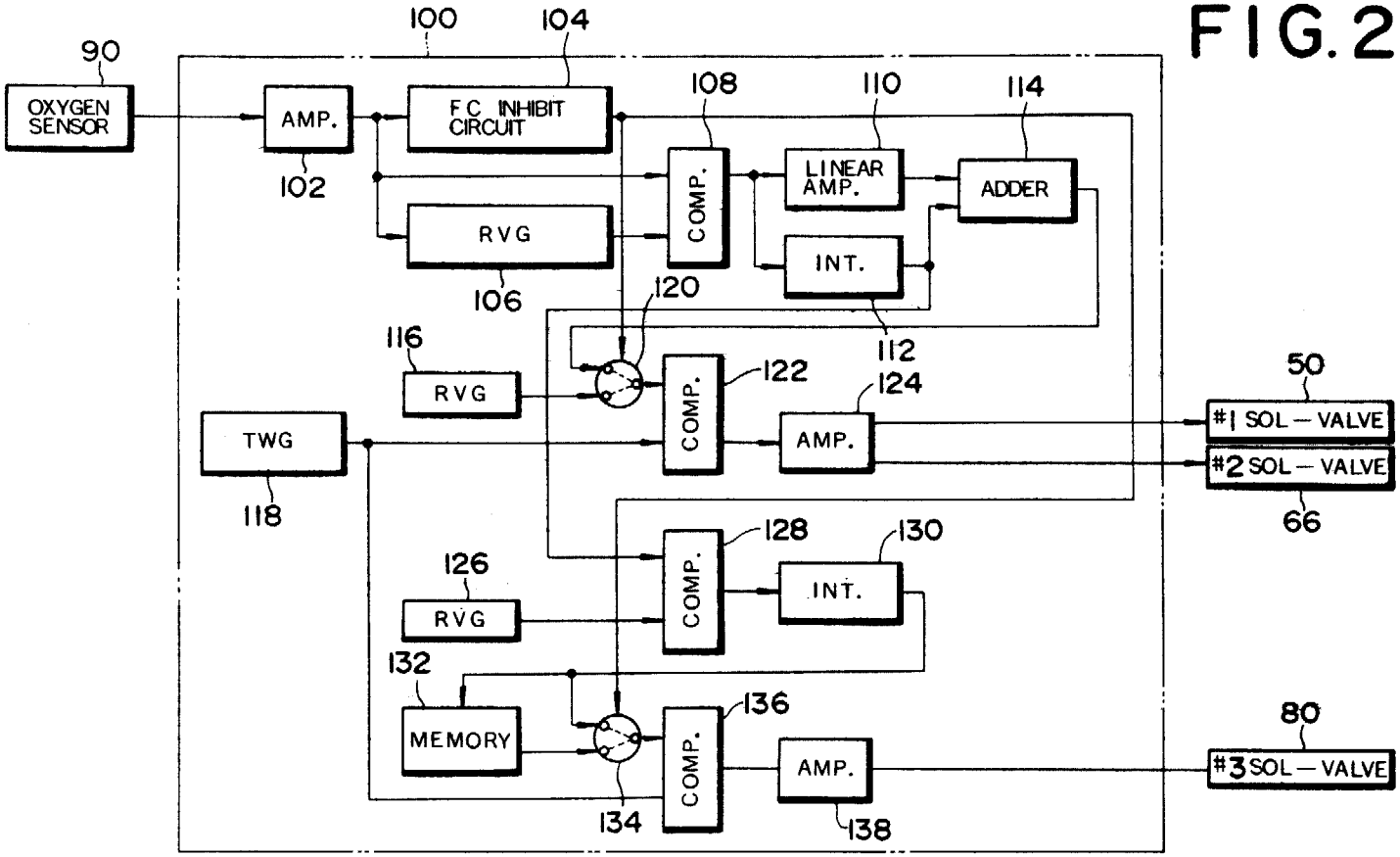
FIG. 2 is a block diagram showing the details of the control circuit used in the carburetor of FIG. 1.

Referring in greater detail to FIG. 2, one embodiment of the control circuit 100 is illustrated as comprising an amplifier 102 having an input from the oxygen sensor 90 which produces an output voltage signal corresponding to the air/fuel ratio of the mixture created by the carburetor. The amplified voltage signal is then applied directly to one input of a first comparator 108 and also to a reference voltage generator circuit 106 which serves to smooth the received voltage signal and applies it to the other input of the first comparator 108. The first comparator 108 produces at its output a voltage signal indicative of the deviation of the sensed air/fuel ratio from the reference value established by the reference voltage generator circuit 106.

The deviation signal is then applied to a linear amplifier 110 which provides at its output a voltage signal proportional to the deviation signal, and also to an integrator circuit 112 which integrates the deviation signal. The output signals from the linear amplifier 110 and integrator circuit 112 are applied to an adder 114 wherein they are added. The output signal from the adder 114 is applied through first switch means 120 to one input of a second comparator 122, the other input of which is coupled to a triangular waveform generator circuit 118. The output of the second comparator 122 will be a squarewave whose duty ratio is dependent upon the voltage signal at the one input of the second comparator 122 or the output of the adder 114 in this case. The squarewave pulse signal from the second comparator 122 is then amplified in an amplifier 124. The output of the amplifier 124 is applied as the first drive pulse signal to the first and second two-way solenoid valves 50 and 66. The first drive pulse signal has a duty ratio dependent upon the output signal of the adder 114. Thus, the duty ratio of the "on" or high time of the first drive signal to the "off" or low time thereof will increase to extend the time period during which the first and second two-way solenoid valves 50 and 66 open when the sensed air/fuel ratio is richer (in terms of fuel) than the reference value established in the reference voltage generator circuit 106, and decrease to shorten the open time period of the first and second solenoid valves 50 and 66 when the sensed air/fuel ratio is leaner (in terms of fuel) than the reference value.

The output of the integrating circuit 112 is also applied to a third comparator 128 which compares it with a reference voltage applied thereto from a reference voltage generator circuit 126. The integrating circuit 112 produces an output voltage signal indicative of the difference between the duty ratio of the first drive pulse signal and a predetermined value, for example, corresponding to the 50 percent of the first drive pulse signal duty ratio. The output of the third comparator 128 is integrated in an integrating circuit 130. The output of the integrating circuit 130 is coupled through second switch means 134 to one input of a fourth comparator 136, the other input of which is coupled to the triangular waveform generator 118. The output of the fourth comparator 136 will be a squarewave whose duty ratio is dependent upon the voltage signal at the one input of the fourth comparator 136 or the output of the integrating circuit 130 in this case. The squarewave pulse signal from the fourth comparator 136 is then amplified in an amplifier 138. The output of the amplifier 138 is applied as the second drive pulse signal to the third solenoid valve 80. The second drive pulse signal has a duty ratio variable with variations in the duty ratio of the first drive pulse signal so that the first drive pulse signal duty ratio can be held around 50%. The duty ratio of the "on" or high time of the second drive pulse signal to the "off" or low time thereof will increase to extend the time period during which the third two-way solenoid valve 80 opens if the duty ratio of the first drive pulse signal is larger than the reference voltage established by the reference voltage generator 126. The duty ratio of the second drive pulse signal will decrease to shorten the open time period of the third solenoid valve 80 if the duty ratio of the first drive pulse signal is smaller than the reference voltage.

For example, when the vehicle runs at high altitudes and the air/fuel ratio of the mixture supplied to the engine gradually becomes richer (in terms of fuel) with decrease in ambient air density, the duty ratio of the second drive pulse signal increases to permit an increasing amount of air into the main and idle fuel wells 38 and 58, thereby holding the first and second solenoid valves 50 and 66 operative around 50% duty ratio without the need of them to operate with increasing duty ratio. Thus, the first and second solenoid valves 50 and 66 have a margine enough to compensate for possible air/fuel ratio changes with high responsibility.

In order to interrupt the air/fuel ratio feedback control under engine warming up and/or other engine operating conditions where the oxygen sensor 90 produces unstable air/fuel ratio indications, a feedback control inhibit circuit 104 is provided which produces an inhibit signal, for example, when the output of the oxygen sensor 90 remains unchanged for a predetermined time. The inhibit signal is applied to the first switch means 120 which thereby disconnects the second comparator 122 from the adder 114 and instead connects it to a reference voltage generator 116. The result is that the duty ratio of the first drive pulse signal is held at a predetermined value established by the reference voltage generator 116, regardless of the oxygen sensor output. The inhibit signal is also applied to the second switch means 134 which thereby disconnects the fourth comparator 136 from the integrating circuit 130 and instead connects it to a nonvolatile memory 132 wherein the output of the integrating circuit 130 is stored. As a result, the duty ratio of the second drive pulse signal is held at a fixed value corresponding to the output of the integrating circuit 130 just before the application of the inhibit signal to the second switch means 134. Thus, under engine warming up conditions where the oxygen sensor 90 tends to provide unstable air/fuel ratio indications, the first drive pulse signal duty ratio is held at a predetermined value such as to maintain a stoichiometric air/fuel ratio whereas the second drive pulse duty ratio is held at a fixed value dependent upon altitude conditions.

It is therefore apparent that there has been provided, in accordance with the present invention, an electronic controlled carburetor having very accurate air/fuel ratio feedback control with high responsibility to engine operating condition variations using solenoid valves of relatively small dynamic range. Thus, the carburetor is effective to maintain smooth engine operation and maximum catalyst performance over all engine operating modes. While this invention has been described in conjunction with a specific embodiments thereof, it is evident that many alternatives, modifications and variations will be apparent to those skilled in the art. Accordingly, it is intended to embrace all alternatives, modifications and variations that fall within the spirit and broad scope of the appended claims.

What is claimed is:

1. An electronic controlled carburetor for an internal combustion engine, comprising:

(a) an induction passage for supplying a combusible mixture to said engine;

(b) a source of fuel;

(c) fuel metering means communicating between said source of fuel and said induction passage, said fuel metering means communicated with the atmosphere through a main air bleed passage and also through an auxiliary air bleed passage;

(d) first and second solenoid valves provided in said main and auxiliary air bleed passages for varying the rates of air flow to said fuel metering means, respectively;

(e) engine exhaust gas analyzing means effective for sensing selected constituents of the exhaust gases of said engine and producing in response thereto an output signal; and (f) a control circuit responsive to the output signal of said engine exhaust gas analyzing means for operating said first and second solenoid valves, said control circuit comprising a first comparator for providing the difference between the output of said engine exhaust gas analyzing means and a predetermined reference value, an amplifier for providing a first signal proportional to the difference, a first integrator for providing a second signal resulting from integrating the difference, an adder for providing a third signal resulting from adding the first and second signals, a first pulse generator for providing a first drive pulse signal having a duty ratio dependent upon the third signal to said first solenoid valve, a second comparator for providing the deviation between the second signal and a predetermined reference value, a second integrator for providing a fourth signal resulting from integrating the deviation, and a second pulse generator for providing a second drive pulse signal having a duty ratio dependent upon the fourth signal to said second solenoid valve.

2. An electronic controlled carburetor according to claim 1, wherein said engine exhaust gas analyzing means comprises an oxygen sensor effective for sensing the oxygen content of the exhaust gases of said engine and producing in response thereto an output signal.

3. An electronic controlled carburetor according to claim 1, wherein said first pulse generator comprises a third comparator having inputs from said adder and a triangular waveform generator, and wherein said second pulse generator comprises a fourth comparator having inputs from said second integrator and said triangular waveform generator.

4. An electronic controlled carburetor according to claim 3, wherein said control circuit comprises feedback control inhibit means for providing an inhibit signal when the output of said engine exhaust gas analyzing means remains unchanged for a predetermined time, first switch means responsive to the inhibit signal for disconnecting said third comparator from said adder and instead connecting the same to a reference voltage source, a nonvolatile memory for storing the output of said second integrator, and second switch means responsive to the inhibit signal for disconnecting said fourth comparator from said second integrator and instead connecting the same to said nonvolatile memory.

5. An electronic controlled carburetor for an internal combustion engine, comprising:

(a) an induction passage for supplying a combusible mixture to said engine;

(b) a source of fuel;

(c) main fuel metering means communicating between said source of fuel and said induction passage, said main fuel metering means communicated with the atmosphere through a main air bleed passage;

(d) idle fuel metering means communicating between said source of fuel and said induction passage, said idle fuel metering means communicated with the atmosphere through an idle air bleed passage;

(e) first and second solenoid valves provided in said main and idle air bleed passages for varying the rates of air flow therethrough, respectively;

(f) an auxiliary air passage communicating said main and idle fuel metering means with the atmosphere;

(g) an auxiliary solenoid valve provided in said auxiliary air passage for varying the rate of air flow therethrough;

(h) engine exhaust gas analyzing means effective for sensing selected constituents of the exhaust gases of said engine and producing in response thereto an output signal; and (i) a control circuit responsive to the output signal of said engine exhaust gas analyzing means for operating said first, second and auxiliary solenoid valves, said control circuit comprising a first comparator for providing the difference between the output of said engine exhaust gas analyzing means and a predetermined reference value, an amplifier for providing a first signal proportional to the difference, a first integrator for providing a second signal resulting from integrating the difference, an adder for providing a third signal resulting from adding the first and second signals, a first pulse generator for providing a first drive pulse signal having a duty ratio dependent upon the third signal to said first and second solenoid valves, a second comparator for providing the deviation between the second signal and a predetermined reference value, a second integrator for providing a fourth signal resulting from integrating the deviation, and a second pulse generator for providing a second drive pulse signal having a duty ratio dependent upon the fourth signal to said auxiliary solenoid valve.

6. An electronic controlled carburetor according to claim 5, wherein said engine exhaust gas analyzing means comprises an oxygen sensor effective for sensing the oxygen content of the exhaust gases of said engine and producing in response thereto an output signal.

7. An electronic controlled carburetor according to claim 5, wherein said induction passage has a venturi section, and wherein said main fuel metering means comprises a main fuel well, a main fuel passage communicating between said source of fuel and said main fuel well, and a main fuel nozzle leading from said main fuel well into said induction passage venturi section.

8. An electronic controlled carburetor according to claim 7, wherein said main air bleed passage leads from said main fuel well and has therein a variable air bleed downstream of said first solenoid valve for varying the rate of air flow therethrough in response to vacuum in said induction passage venturi section.

9. An electronic controlled carburetor according to claim 8, wherein said main fuel well has therein an emulsion tube communicated at its upper portion with the atmosphere through an air bleed restriction orifice.

10. An electronic controlled carburetor according to claim 5, wherein said induction passage has therein a throttle valve, and wherein said idle fuel metering means comprises an idle fuel well, an idle fuel passage communicating between said source of fuel and said idle fuel well, and a fuel passage extending from said idle fuel well and opening into said induction passage at a point juxtaposed to an edge of said throttle valve when the throttle valve is in its idle or closed position.

11. An electronic controlled carburetor according to claim 10, wherein said idle air bleed passage leads from said idle fuel well.

12. An electronic controlled carburetor according to claim 11, wherein said idle fuel well is communicated through an air bleed restriction orifice with the atmosphere.

13. An electronic controlled carburetor according to claim 5, said first pulse generator comprises a third comparator having inputs from said adder and a triangular waveform generator, and wherein said second pulse generator comprises a fourth comparator having inputs from said second integrator and said triangular waveform generator.

14. An electronic controlled carburetor according to claim 13, wherein said control circuit comprises feedback control inhibit means for providing an inhibit signal when the output of said engine exhaust gas analyzing means remains unchanged for a predetermined time, first switch means responsive to the inhibit signal for disconnecting said third comparator from said adder and instead connecting the same to a reference voltage source, a nonvolatile memory for storing the output of said second integrator, and second switch means responsive to the inhibit signal for disconnecting said fourth comparator from said second integrator and instead connecting the same to said nonvolatile memory.

* * * * *